US006582242B2

(12) United States Patent
Murakami et al.

(10) Patent No.: US 6,582,242 B2
(45) Date of Patent: Jun. 24, 2003

(54) ELECTRICAL CONNECTOR WITH INCREASED CONTACT RELIABILITY

(75) Inventors: Takao Murakami, Shizuoka (JP); Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/883,332

(22) Filed: Jun. 19, 2001

(65) Prior Publication Data

US 2002/0001987 A1 Jan. 3, 2002

(30) Foreign Application Priority Data

Jun. 27, 2000 (JP) ..... 2000-192486

(51) Int. Cl.[7] ..... H01R 13/52; H01R 13/40
(52) U.S. Cl. ..... 439/271; 439/595
(58) Field of Search ..... 439/271, 274, 439/587, 589, 523, 599, 686, 595

(56) References Cited

U.S. PATENT DOCUMENTS 5,931,699 A * 8/1999 Saito ..... 439/275
5,941,737 A * 8/1999 Sakai et al. ..... 439/752
6,244,898 B1 * 6/2001 Suzuki ..... 439/587

FOREIGN PATENT DOCUMENTS

| | | |
|---|---|---|
| EP | 0 942 494 A2 | 9/1999 |
| EP | 1 056 161 A1 | 11/2000 |
| JP | 8-273732 | 10/1996 |
| JP | 9-106847 | 4/1997 |

* cited by examiner

*Primary Examiner*—Chandrika Prasad
(74) *Attorney, Agent, or Firm*—Morgan, Lewis & Bockius LLP

(57) ABSTRACT

A first elastic member is provided at a rear end portion of a terminal. An inner housing includes an inner peripheral wall which defines a first chamber for retaining at least a front end portion of the terminal, and an outer peripheral wall extending parallel with the inner peripheral wall while defining a gap therebetween. An outer housing includes a peripheral wall which defines a second chamber for retaining at least first elastic member. A second elastic member is fitted around the peripheral wall of the outer housing. The inner housing and the outer housing are engaged with each other such that a front end portion of the peripheral wall of the outer housing is inserted into the gap formed between the inner peripheral wall and the outer peripheral wall of the inner housing, and such that a rear end face of the outer peripheral wall of the inner housing is brought into an intimate contact with the second elastic member.

2 Claims, 6 Drawing Sheets

ELECTRICAL CONNECTOR WITH INCREASED CONTACT RELIABILITY

BACKGROUND OF THE INVENTION

This invention relates to a connector, such as a waterproof connector, in which a wire, connected to a terminal received in a chamber in a connector housing, is sealed by a rubber plug.

A connector of the type described is disclosed in Japanese Patent Publication No. 9-106847A, this connector being shown in FIGS. 7 to 10. As shown in FIGS. 7 and 8, this connector 1 comprises a housing 2, having a pair of right and left tubular chambers 3 for respectively receiving terminals 9 each press-clamping a wire 7 and a rubber plug 8, a box-shaped fixture 5 fitted on outer faces of peripheral walls of the two tubular chambers 3 at front end portions thereof, and an annular waterproof packing 6 fitted on the outer faces of the peripheral walls of the two tubular chambers 3 at rear end portions thereof. A notch 3*a* is formed in a central portion of the upper front portion of the peripheral wall of each tubular chamber 3, and a cantilevered flexible arm 4 for retaining the terminal 9 is formed so as to extend in this notch portion 3*a*.

For assembling the connector 1, a pair of small projections 5*b*, formed respectively on inner faces of right and left side walls of the fixture 5, are fitted respectively in front ends of slots 3*b* formed respectively in the side walls of the two tubular chambers 3 as shown in FIGS. 8 and 9, so that the fixture 5 is provisionally fitted (provisionally retained) on the front end portions of the two tubular chambers 3 each of which is disposed forwardly of a region where the flexible arm 4 can be elastically deformed. Then, the terminals 9, each press-clamping the wire 7 and the rubber plug 8, are inserted respectively into the tubular chambers 3 from the rear side of the housing 2 as shown in FIG. 8, so that each terminal 9 is primarily retained in the tubular chamber 3 by the flexible arm 4. Then, when the fixture 5 is further pushed as shown in FIG. 10, projections 5*a*, formed on an inner face of an upper wall of the fixture 5, are fitted respectively into front ends of the notches 3*a*, and are disposed respectively at the regions of elastic deformation of the flexible arms 4, so that the fixture 5 is completely fitted (completely retained) on the pair of tubular chambers 3. As a result, the elastic deformation of each flexible arm 4 is prevented, so that each terminal 9 is retained in a double manner.

In the conventional connector 1, each terminal 9 is received in the corresponding tubular chamber 3 in the housing 2, and is retained by the elastic arm 4. When vibrations, applied to the housing 2, are transmitted to each terminal 9, the vibrations are absorbed only by the rubber plug 8 press-clamped to a rear portion of the terminal 9. Therefore vibrations, acting on a terminal body of the terminal 9, could not be absorbed only by the rubber plug 8, and when the connector 1 is mounted, for example, on a vehicle, a portion of contact of the terminal 9 with a mating terminal is worn by the vibrations, so that the reliability (contact reliability) of the terminal 9 becomes low.

SUMMARY OF THE INVENTION

Therefore, this invention has been made in order to solve the above problem, and an object of the invention is to provide a connector in which vibrations, transmitted to a terminal, are positively absorbed by an elastic member, interposed between and held in intimate contact with an outer housing and an inner housing, thereby enhancing a contact reliability of the terminal.

In order to achieve the above object, according to the present invention, there is provided a connector, comprising:

a terminal;

a first elastic member, provided at a rear end portion of the terminal;

an inner housing, including an inner peripheral wall which defines a first chamber for retaining at least a front end portion of the terminal, and an outer peripheral wall extending parallel with the inner peripheral wall while defining a gap therebetween;

an outer housing, including a peripheral wall which defines a second chamber for retaining at least first elastic member; and a second elastic member, fitted around the peripheral wall of the outer housing, wherein the inner housing and the outer housing are engaged with each other such that a front end portion of the peripheral wall of the outer housing is inserted into the gap formed between the inner peripheral wall and the outer peripheral wall of the inner housing, and such that a rear end face of the outer peripheral wall of the inner housing is brought into an intimate contact with the second elastic member.

In this configuration, in addition to the first elastic member fitted in the outer housing, vibrations, applied to the outer housing, are absorbed by the second elastic member, interposed between and held in intimate contact with the inner housing and the outer housing, and therefore will not be transmitted to the terminal. Therefore, when the connector is mounted, for example, on a vehicle, that portion of contact of the terminal with a mating terminal will not be subjected to wear, so that the contact reliability of the terminal is enhanced.

Preferably, the inner housing and the outer housing are engaged with each other such that a clearance is formed between an outer face of the inner peripheral wall of the inner housing and an inner face of the peripheral wall of the outer housing.

In this configuration, since the vibrations applied to the outer housing can be further prevented from being transmitted to the terminal, the contact reliability of the terminal is further enhanced.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
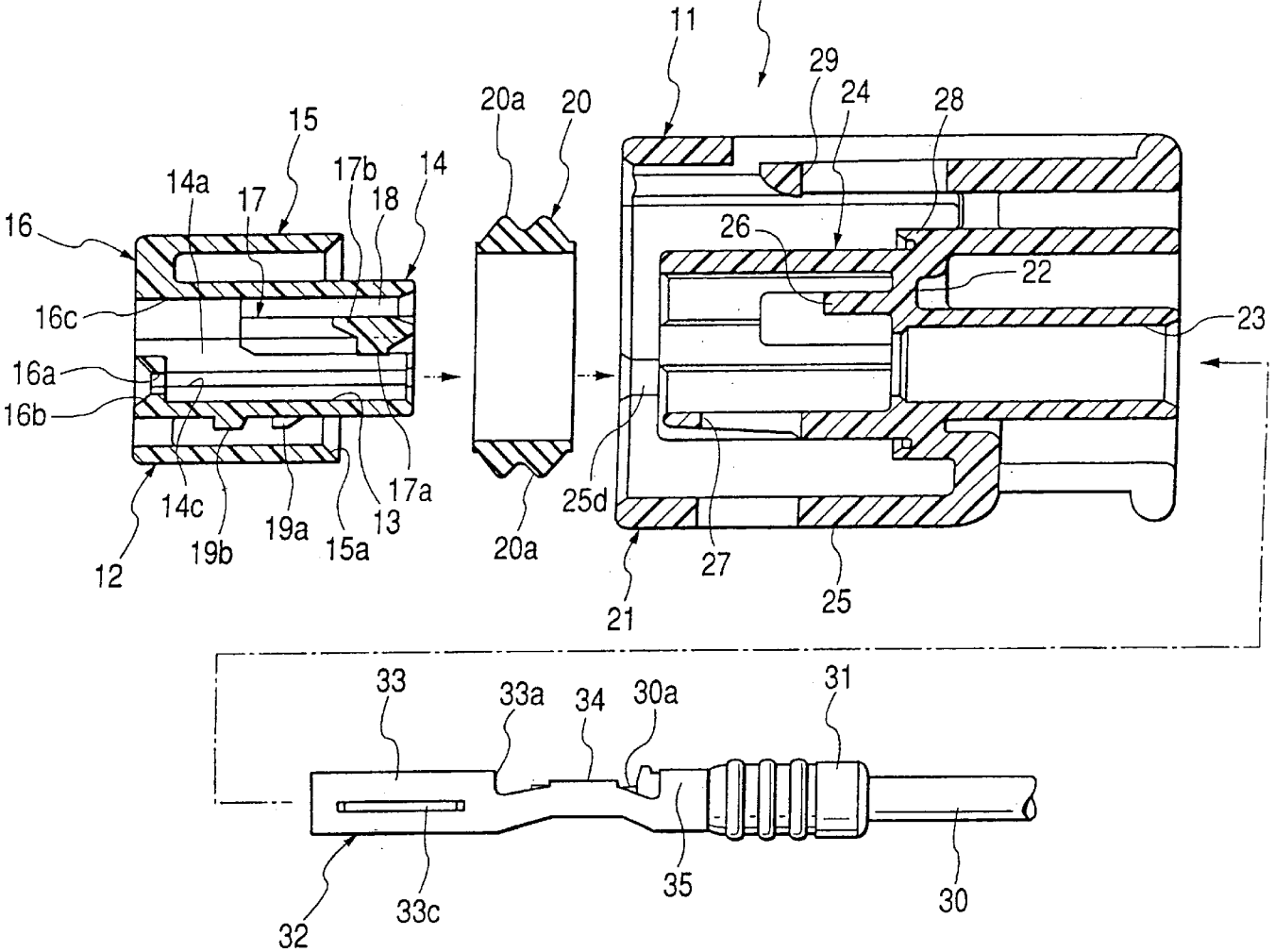
FIG. 1 is a vertical cross-sectional view of one preferred embodiment of a connector of the invention, showing a condition before this connector is assembled.

One preferred embodiment of the present invention will now be described with reference to the drawings.

As shown in FIGS. 1 to 6, a connector housing 11 of the connector 10 comprises the inner housing 12, made of a synthetic resin, and the outer housing 21 of a synthetic resin to be fitted with the inner housing 12. The inner housing 12 has a pair of right and left chambers 13 formed integrally therewith for respectively receiving terminals 32 each press-clamping a wire 30 and a rubber plug 31. The outer housing 21 has a pair of right and left insertion paths 23 of a substantially cylindrical shape each formed integrally therewith for receiving the wire 30, the rubber plug 21 and the terminal 32. A waterproof packing 20 is provided between the inner housing 12 and the outer housing 21.

The inner housing 12 includes an inner peripheral wall portion 14 of a substantially square shape (having an open rear end) for fitting in an inner peripheral wall portion 24 of the outer housing 21, an outer peripheral wall portion 15 of a substantially square shape, which extends rearwardly in surrounding relation to the inner peripheral wall portion 14, and can be fitted on the inner peripheral wall portion 24 of the outer housing 21, and a front wall portion 16 from which the inner and outer peripheral wall portions 14 and 15 extend rearwardly. Within the inner peripheral wall portion 14, the pair of right and left chambers 13 are formed respectively on opposite sides of a partition wall 14*a* serving also as a central side wall of the inner peripheral wall portion 14.

Cantilevered flexible retainers 17 each for retaining the terminal 32 received in the chamber 13 are formed integrally on an inner face of an upper portion of the inner peripheral wall portion 14 of the inner housing 12, and are opposed to the chambers 13, respectively, the flexible retainers 17 extending from the front portion to the rear end. A retaining projection 17*a* for retaining engagement with a retained portion 33*a* of the terminal 32 is formed integrally on a lower face of a free end of each flexible retainer 17, and a cancellation projection 17*b* is formed integrally on a rear portion of the flexible retainer 17 near to the free end thereof. A flexure-allowing space 18 is formed between each flexible retainer 17 and an upper wall of the inner peripheral wall portion 14. A recessed groove 14*c* serving as a positioning guide portion, is formed in each of opposed side walls 14*a* and 14*b* of each chamber 13 in the inner peripheral wall portion 14, and extends horizontally, the groove 14*c* being disposed substantially centrally of the height of the wall 14*a*, 14*b*.

A provisional fitting claw (provisional fitting member) 19*a* is formed integrally on a lower outer face of the inner peripheral wall portion 14 of the inner housing 12 at a rear portion thereof, and this claw 19*a* can be engaged in an engagement hole 27, formed in the inner peripheral wall portion 24 of the outer housing 21, to hold the two housings 12 and 21 in a provisionally-fitted condition A complete fitting claw (complete fitting member) 19*b* is formed integrally on the lower outer face of the inner peripheral wall portion 14 at a front portion thereof, and this claw 19*b* can be engaged in the engagement hole 27 in the outer housing 21 to hold the two housings 12 and 21 in a completely-fitted condition.

In the above provisionally-fitted condition, when each terminal 32 is inserted into the corresponding insertion path 23 of a substantially cylindrical shape from the rear side thereof, and is received in the corresponding chamber 13, the terminal 32 is retained by the flexible retainer 17. In the provisionally-fitted condition, the front wall portion 16 of the inner housing 12 forwardly projects a predetermined distance from the front side of the outer housing 21 (This projection distance is indicated by reference character Y in FIG. 2). The rubber plug 31, press-clamped by a plug clamper 35 formed at a rear end portion of the terminal 32, serves also as a visual confirmation member. When the connector is shifted from the provisionally-fitted condition to the completely-fitted condition, each rubber plug (visual confirmation member) 31 moves into the corresponding insertion path 23, and this movement of the rubber plug 31 can be visually confirmed from the rear side of the outer housing 21 (The amount of movement of each rubber plug 31 is indicated by reference character Z in FIG. 4).

A distal end 15*a* of the outer peripheral wall portion 15 of the inner housing 12 is formed into a tapering shape, so that when the inner housing 12 and the outer housing 21 are completely fitted together, the distal end 15*a* of the outer peripheral wall portion 15 of the inner housing 12 and a packing support portion 28, formed on the inner peripheral wall portion 24 of the outer housing 21, hold the waterproof packing 20 therebetween in closely-contacted relation thereto.

Through holes 16*a* each for passing a mating terminal of a mating connector (not shown) therethrough are formed respectively through those portions of the front wall portion 16 of the inner housing 12 substantially aligned respectively with the chambers 13. A tapering guide face 16*b* is formed at a front peripheral edge portion of each through hole 16*a*. Jig insertion holes 16*c* each for inserting a bar-like terminal-withdrawing jig (not shown) therethrough are formed through the front wall portion 16 of the inner housing 12, and are disposed above the through holes 16*a*, respectively.

When a distal end portion of the terminal-withdrawing jig is inserted into the jig insertion hole 16*c* in the same direction as a mating connector-inserting direction, the distal end portion of this terminal-withdrawing jig is brought into abutting engagement with a slanting face of the cancellation projection 17*b* of the flexible retainer 17 to move the retaining projection 17*a* upward. More specifically, in the provisionally-fitted condition of the inner and outer housings 12 and 21, the cancellation projection 17*b* of the flexible retainer 17 is pressed by the distal end portion of the terminal-withdrawing jig, inserted through the jig insertion hole 16*c*, so that the retaining projection 17*a* of the flexible retainer 17 is displaced out of engagement with the retained portion 33*a* of the terminal 32 in the flexure-allowing space 18.

The waterproof packing 20 is made of rubber, and has an annular shape. Front and rear convex portions 20*a* of a substantially triangular cross-section are formed integrally on the outer peripheral face of the waterproof packing 20. The front and rear convex portions 20*a* are held between the distal end 15*a* of the outer peripheral wall portion 15 of the inner housing 12 and the packing support portion 28, formed on the inner peripheral wall portion 24 of the outer housing 21, in closely-contacted relation thereto.

The outer housing 21 includes the pair of insertion paths 23 of a substantially cylindrical shape, integrally formed on and extending rearwardly from a central partition wall 22, the inner peripheral wall portion 24 of a substantially square shape, which is integrally formed on and extends forwardly from the partition wall 22, and serves as a insertion path communicating with the insertion paths 23, and the outer peripheral wall portion 25 of a substantially square shape surrounding the inner peripheral wall portion 24. Thus, the outer housing 21 has a double-wall construction having open front and rear ends. The rubber plug (waterproof plug) 31, which is press-clamped to the terminal 32, and is closely fitted on the wire 30, is inserted into the insertion path 23 by press-fitting or other means. Namely, in the completely-fitted condition of the connector, the rubber plug 31, which is fitted on the wire 30, and is secured to the terminal 32, is held between the wire 30 and the insertion path 23 of a substantially cylindrical shape in closely-contacted relation thereto.

Plate-shaped flexure-preventing members 26 are formed integrally on the partition wall 22 of the outer housing 21, and extend therefrom into the interior of the inner peripheral wall portion 24, and these flexure-preventing members 26 are opposed respectively to the flexure-allowing spaces 18 for the flexible retainers 17 of the inner housing 12. In the completely-fitted condition of the inner and outer housings 12 and 21, each of the flexure-preventing members 26 is inserted in the flexure-allowing space 18 to prevent the flexing (or elastic deformation) of the flexible retainer 17.

The engagement hole 27 is formed through the lower wall of the inner peripheral wall portion 24 of the outer housing 21, and the provisional fitting claw 19*a* and the complete fitting claw 19*b*, formed on the inner peripheral wall portion 14 of the inner housing 12, can be releasably engaged with this engagement hole 27. A tapered packing support portion 28 is formed integrally at the proximal end of the inner peripheral wall portion 24 of the outer housing 21 at which the partition wall 22 is provided. The tapered face is so formed as to be along with a surface of the convex portion 20*a* of the annular waterproof packing 20 of rubber.

Figure 5:
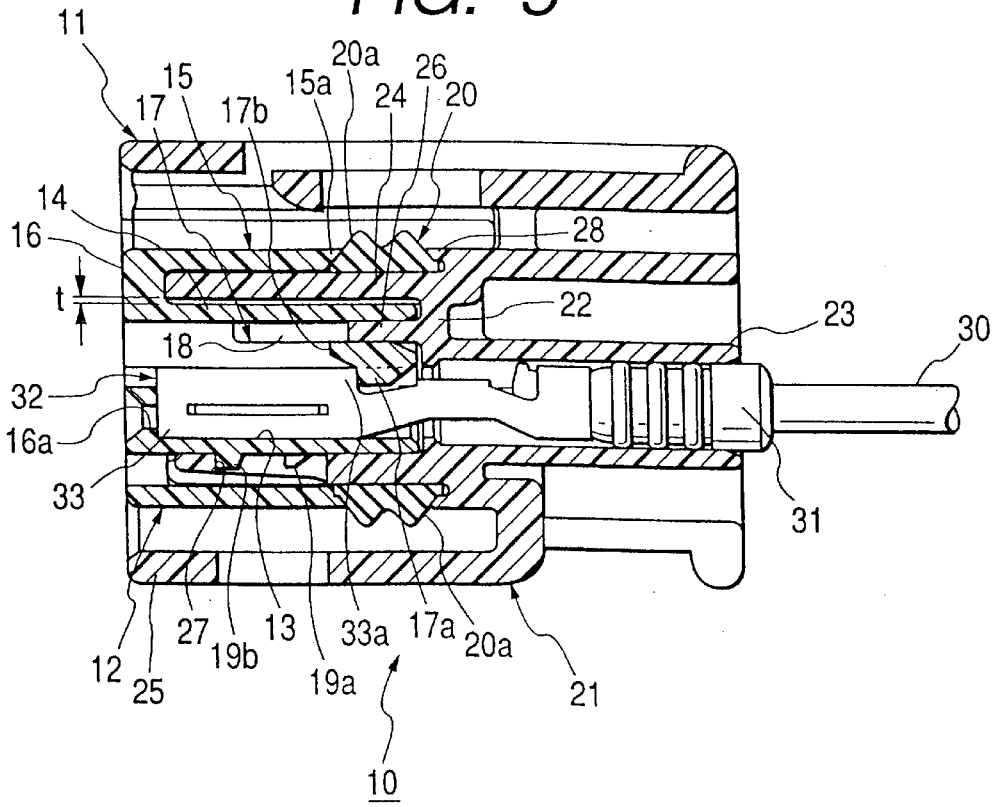
FIG. 5 is a vertical cross-sectional view of the connector in a completely-assembled condition in which the inner housing is completely fitted in the outer housing.
Figure 6:
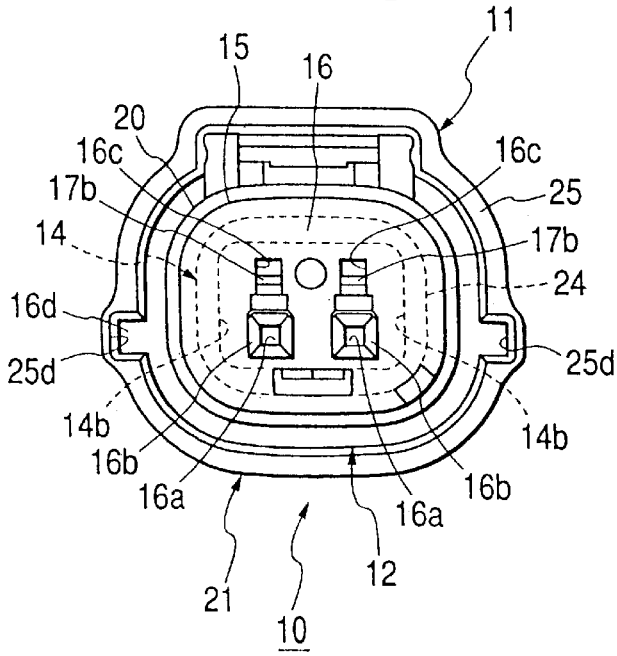
FIG. 6 is a front-elevational view of the connector in its completely-assembled condition.
Figure 7:
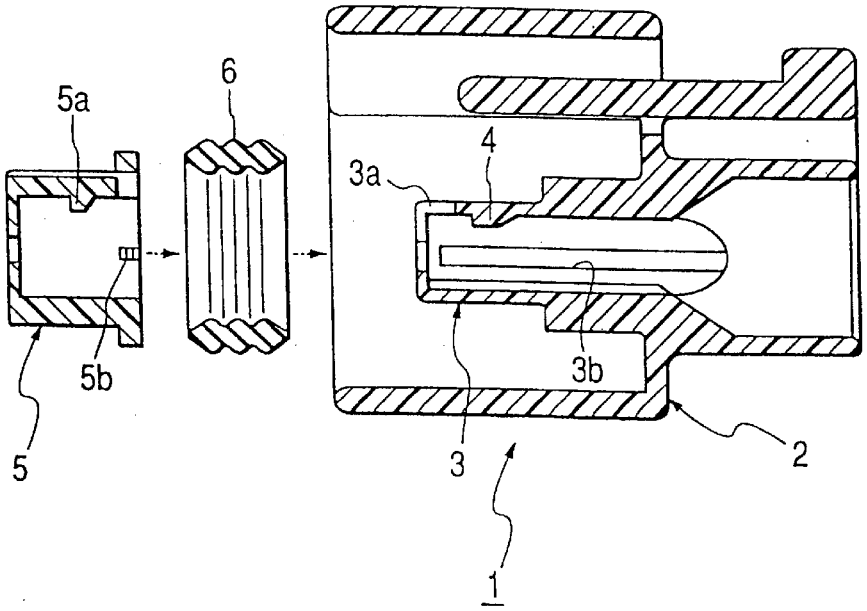
FIG. 7 Related Art
FIG. 7 is a vertical cross-sectional view of a related connector, showing a condition before this connector is assembled.
Figure 8:
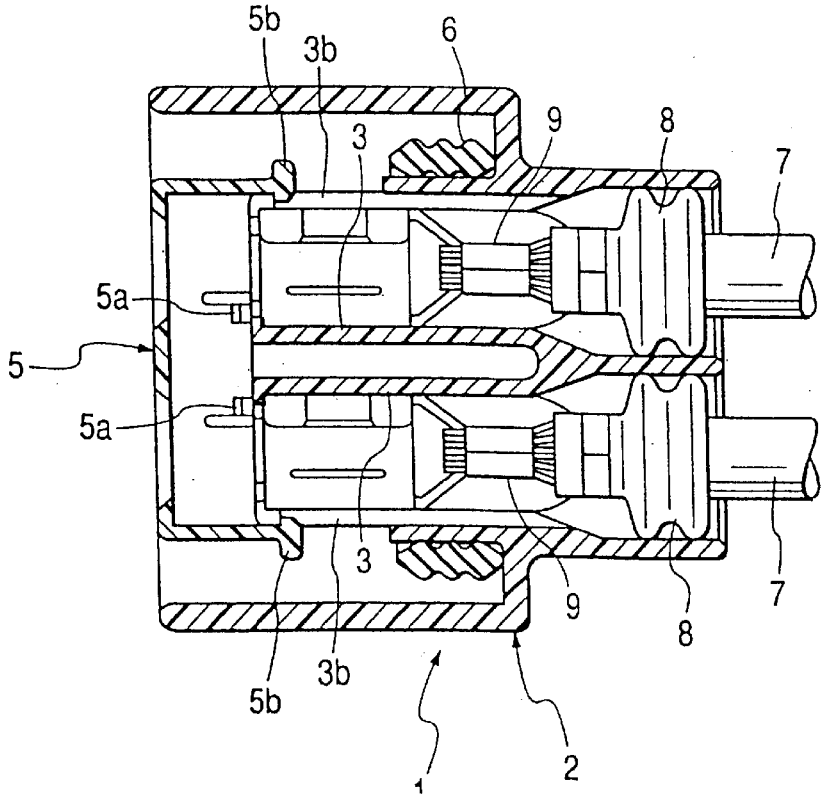
FIG. 8 Related Art
FIG. 8 is a horizontal cross-sectional view of the related connector, showing a condition in which a fixture is provisionally fitted on a housing.
Figure 9:
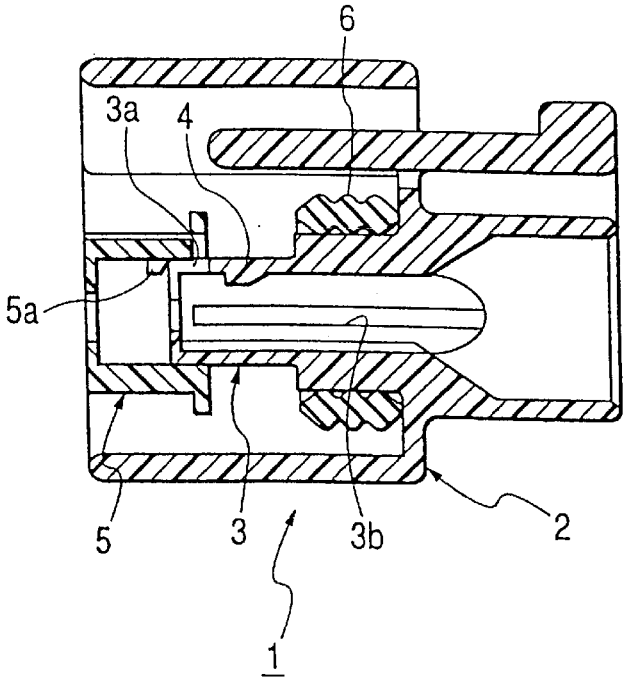
FIG. 9 Related Art
FIG. 9 is a vertical cross-sectional view of the related connector, showing a condition in which the fixture is provisionally fitted on the housing.
Figure 10:
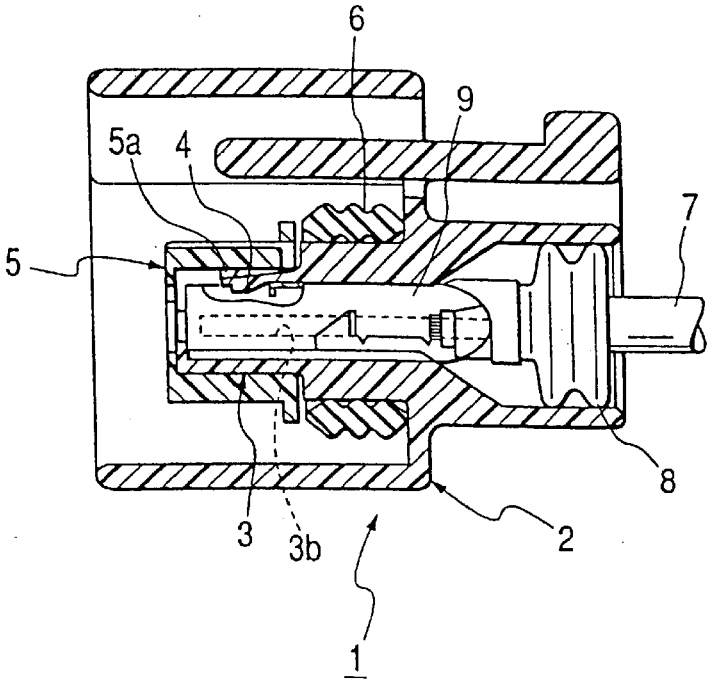
FIG. 10 Related Art
FIG. 10 is a vertical cross-sectional view of the related connector in its completely-assembled condition in which the fixture is completely fitted on the housing

Recesses 25*d* for respectively guiding convex portions, formed respectively on opposite sides of the mating connector (not shown), are formed respectively in inner faces of the opposite side walls of the outer peripheral wall portion 25 of the outer housing 21, each of the recesses 25*d* being disposed substantially centrally of the height of the side wall. A retaining hole 29 is formed through a front portion of the upper wall of the outer peripheral wall portion 25 of the outer housing 21, and an elastic retaining arm on the mating connector (not shown) is releasably engageable in this retaining hole 29. In an assembled condition of the inner and outer housings 12 and 21, a clearance t is formed between the inner peripheral wall portion 14 of the inner housing 12 and the inner peripheral wall portion 24 of the outer housing 21, as shown in FIG. 5.

Figure 2:
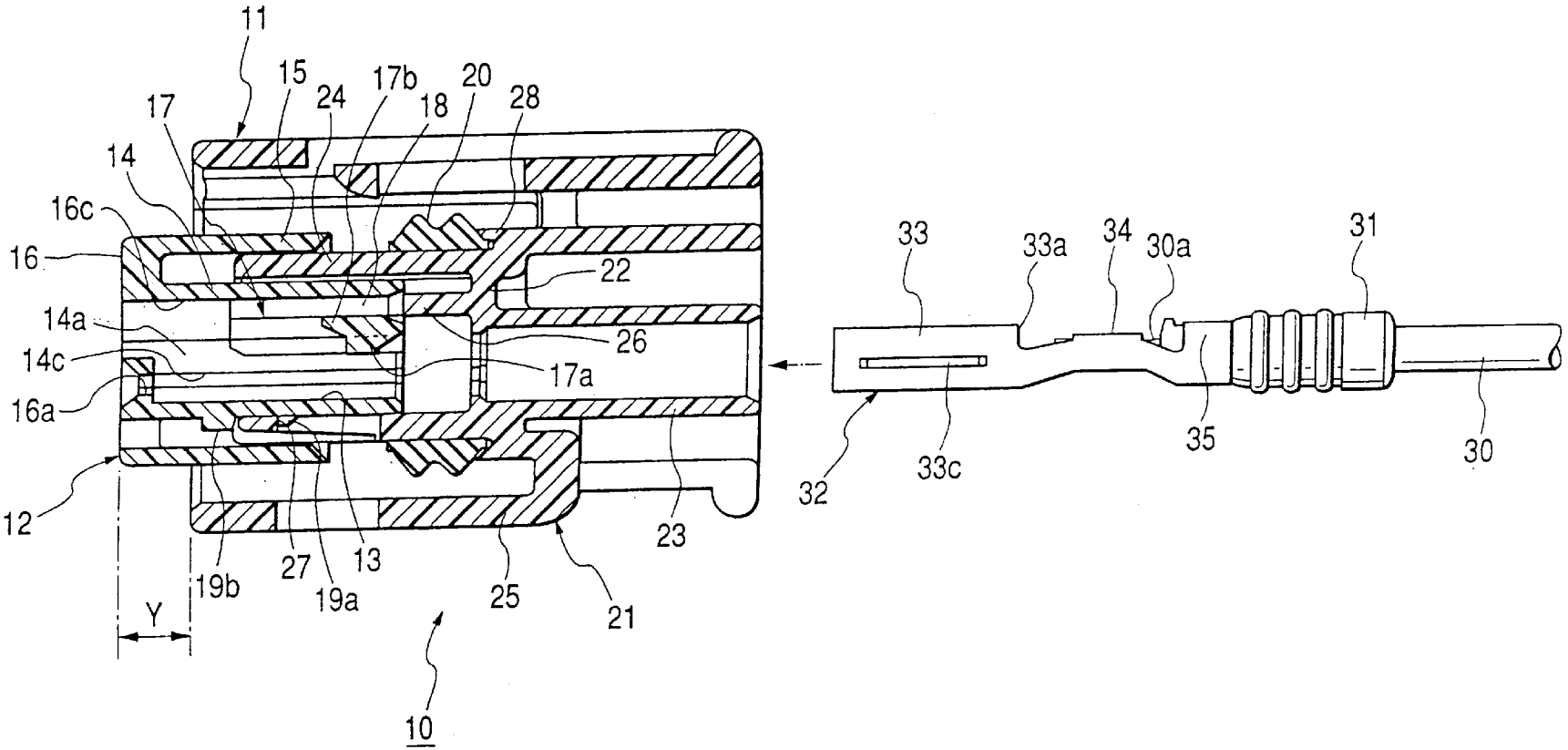
FIG. 2 is a vertical cross-sectional view of the connector, showing a condition in which an inner housing is provisionally fitted in an outer housing, with terminals not yet inserted.

As shown in FIGS. 1 and 2, the terminal 32 has a female terminal body 33 of a square tubular shape, and convex portions 33*c*, each serving as a positioning member, are integrally formed respectively on opposite side faces of the terminal body 33, and extend horizontally, each of the convex portions 33*c* being disposed substantially centrally of the height of the side face. The convex portions 33*c* are engaged respectively in the grooves 14*c*, formed respectively in the opposed side walls of the chamber 13, thereby properly positioning the terminal 32 received in the chamber 13. When the terminal is thus received in the chamber, the upper edge (retained portion) 33*a* of the rear end of the terminal body 33, which serves as the retaining portion, is retained by the retaining projection 17*a* of the flexible retainer 17. A conductor 30*a* of the wire 30 is press-clamped by a conductor clamper 34 of the terminal 32, and the front end portion of the rubber plug 31 is press-clamped by the plug clamper 35 of the terminal 32.

For assembling the connector 10 of this embodiment, the waterproof packing 20 is fitted in the packing support portion 28 of the inner peripheral wall portion 24 of the outer housing 21 forming the outer portion of the connector housing 11, as shown in FIG. 2. Then, the inner peripheral wall portion 14 of the inner housing 12, forming the inner portion of the connector housing 11, is fitted into the inner peripheral wall portion 24 of the outer housing 21, and the provisional fitting claw 19*a*, formed on the inner peripheral wall portion 14 of the inner housing 12, is engaged with the engagement hole 27 in the inner peripheral wall portion 24 of the outer housing 21, thereby provisionally fitting the inner housing 12 in the outer housing 21. In this provisionally-fitted condition, the front wall portion 16 of the inner housing 12 forwardly projects a distance Y from the outer housing 21.

Figure 3:
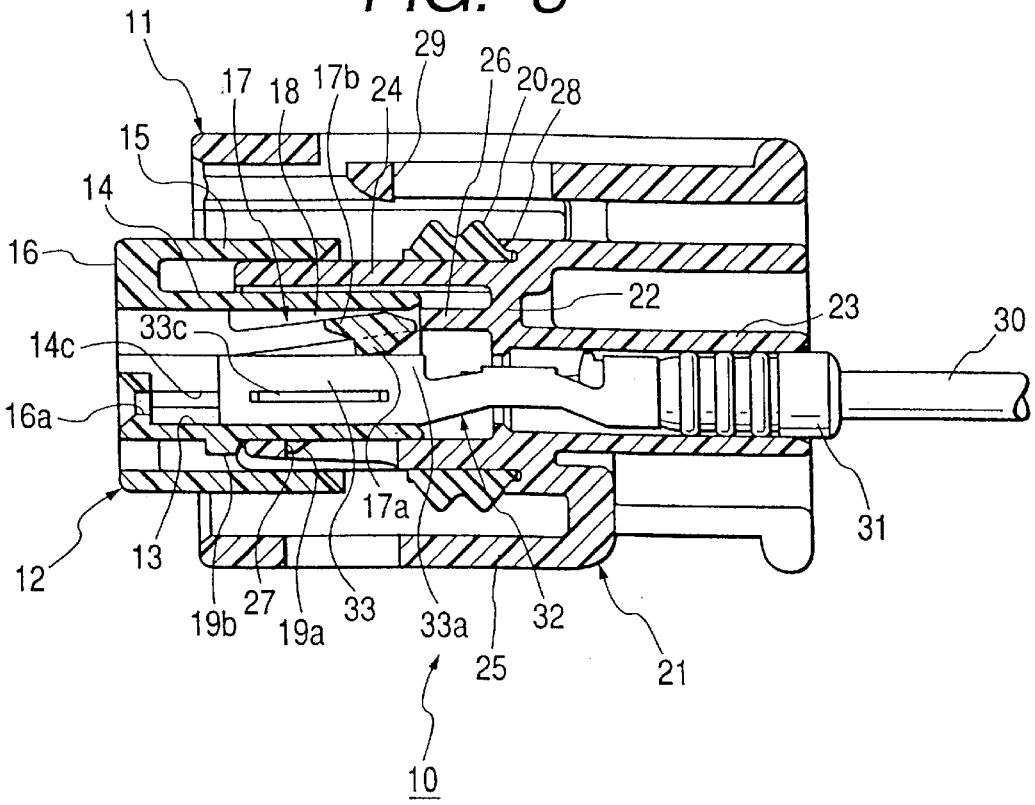
FIG. 3 is a vertical cross-sectional view of the connector in the above provisionally-fitted condition, showing a condition during the insertion of the terminals.
Figure 4:
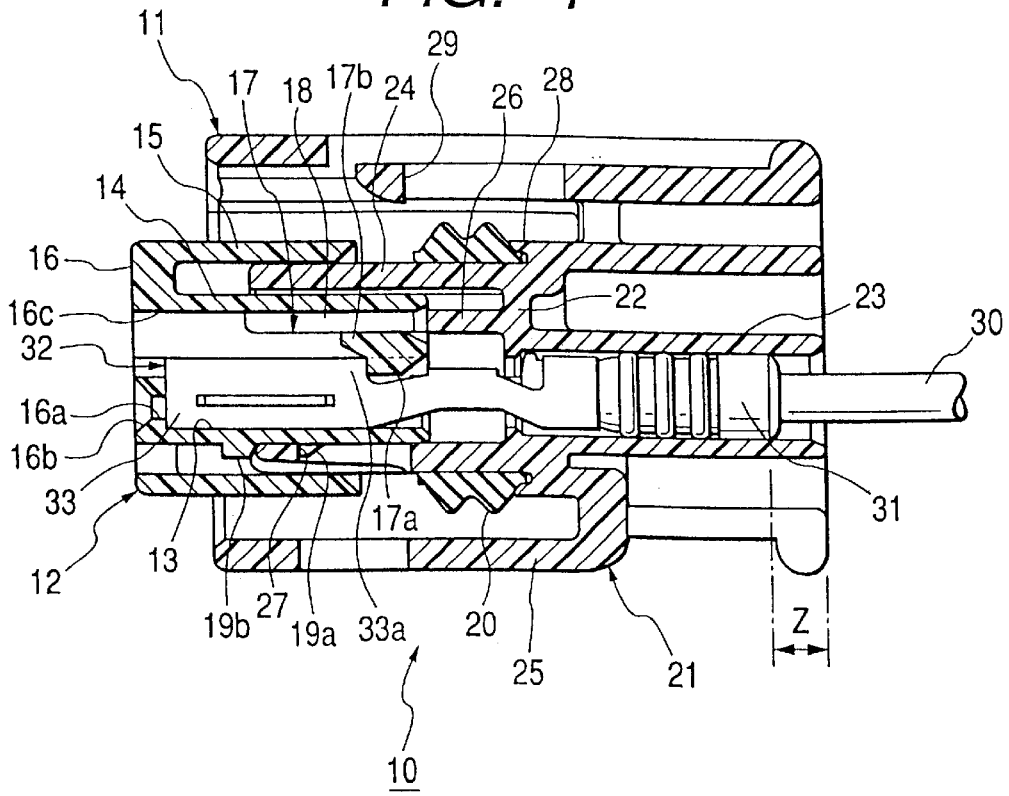
FIG. 4 is a vertical cross-sectional view of the connector in the provisionally-fitted condition, showing a condition in which the terminals are primarily retained.

Then, in the provisionally-fitted condition, when each terminal 32, press-clamping the wire 30 and the rubber plug 31, is inserted into the insertion path 23 in the outer housing 21, and is received in the chamber 13 in the inner housing 12 as shown in FIG. 3, the rear upper edge 33*a* of the terminal body 33 of the terminal 32 is retained by the retaining projection 17*a* of the flexible retainer 17 as shown in FIG. 4, so that the terminal 32 is primarily retained by the flexible retainer 17.

Then, when the inner peripheral wall portion 14 of the inner housing 12 is further fitted into the inner peripheral wall portion 24 of the outer housing 21 as shown in FIG. 5, the complete fitting claw 19*b*, formed on the inner peripheral wall portion 14 of the inner housing 12, is retainingly engaged in the engagement hole 27 in the inner peripheral wall portion 24 of the outer housing 21, and the inner housing 12 is completely fitted in the outer housing 21, thus completing the assembling of the connector 10.

When the inner housing 12 is completely fitted into the outer housing 21, each flexure-preventing member 26 of the outer housing 21 is inserted into the flexure-allowing space 18 for the flexible retainer 17 of the inner housing 12. As a result, the flexure-preventing member 26 positively prevents the flexible retainer 17, primarily retaining the terminal 32, from being elastically deformed away from the terminal 32. Therefore, the terminal 32 is retained by the retaining projection 17*a* of the flexible retainer 17, and also is indirectly retained by the flexure-preventing member 26 which prevents the elastic deformation of the flexible retainer 17. Thus, each terminal is easily and positively retained in a double manner.

The completion of the double-retaining of each terminal 32 by the flexible retainer 17 of the inner housing 12 and the flexure-preventing member 26 of the outer housing 21 can be easily confirmed from the rearward movement (i.e., the movement over the distance Y in FIG. 2) of the inner housing 12 at the front side of the outer housing 21 at the time of shifting of the inner housing 12 from the provisionally-fitted condition to the completely-fitted condition, and also from the rearward movement (i.e., the movement over a distance Z in FIG. 4) of the rubber plug 31 in the substantially-cylindrical insertion path 23 at the rear portion of the outer housing 21.

Namely, the rearward movement of the inner housing 12 at the front side of the outer housing 21 at the time of shifting of the inner housing 12 from the provisionally-fitted condition to the completely-fitted condition and the rearward movement of the rubber plug 31 (occurring simultaneously with the above rearward movement of the inner housing 12) in the substantially-cylindrical insertion path 23 at the rear portion of the outer housing 21 can be confirmed at the front and rear sides of the connector housing 11, respectively. Therefore, in a wire harness-producing process, the movement of the operator for inspection and confirmation purposes is much less as compared with the related construction, and the efficiency of the operation is much enhanced.

When the inner housing 12 and the outer housing 21 are completely fitted together, the slanting face of the distal end 15*a* of the outer peripheral wall portion 15 of the inner housing 12 and the packing support portion 28 hold the waterproof packing 20 therebetween in closely-contacted relation thereto. In this completely-fitted condition, the rubber plug 31, which is fitted on the wire 30, and is secured to the terminal 32, is received in the insertion path 23 in the outer housing 21 in closely-contacted relation thereto. With these effects, the waterproof performance of the assembled connector 10 is much enhanced.

Thus, in the completely-fitted condition of the inner housing 12 and the outer housing 21, the convex portions 20*a* of the waterproof packing 20, made of rubber, are disposed between and held in intimate contact respectively with the slanting face of the distal end 15*a* of the outer peripheral wall portion 15 of the inner housing 12 which retains the front end portion of the terminal 32, and the packing support portion 28 of a V-shaped cross-section formed at the proximal end of the inner peripheral wall portion 24 of the outer housing 21 which retains the rear end portion of the terminal 32. Therefore, vibrations, applied to the outer housing 21, can be absorbed by the waterproof rubber packing 20. Therefore, vibrations, applied to the outer housing 21, will not be transmitted directly to the terminals 32, and when the connector 10 is mounted, for example, on a vehicle (not shown), that portion of contact of each terminal 32 with the mating terminal, fitted in the terminal body 33, will not be worn by the vibrations applied to the outer housing 21, so that the contact reliability of the terminal 32 is enhanced.

Particularly, as shown in FIG. 5, the predetermined clearance t is formed between the inner peripheral wall portion 14 of the inner housing 12 and the inner peripheral wall portion 24 of the outer housing 21, and the rubber plug 31 is mounted on that portion of each wire 30 connected to the terminal 32, and in the completely-fitted condition of the inner housing 12 and the outer housing 21, the rubber plug 31 is held between the wire 30 and the substantially cylindrical insertion path 23 of the outer housing 21 in closely-contacted relation thereto. Therefore, vibrations, applied to the outer housing 21, can be positively absorbed by the waterproof rubber packing 20 and the rubber plugs 31, and will not be transmitted directly to the terminal body 33 of each terminal 32, and wear of the contact portion of each terminal 32 due to such vibrations can be positively prevented, so that the contact reliability of the terminal 32 is further enhanced.

In the above embodiment, although the terminals, each press-clamping the rubber plug at its rear end portion, are used, there may be used the type of terminals to which a rubber plug is not press-clamped, in which case the rubber plug is fitted on the wire.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector, comprising:

a terminal;

a first elastic member, provided at a rear end portion of the terminal;

an inner housing, including an inner peripheral wall which defines a first chamber for retaining at least a front end portion of the terminal, and an outer peripheral wall extending parallel with the inner peripheral wall while defining a gap therebetween;

an outer housing, including a peripheral wall which defines a second chamber for retaining at least first elastic member; and a second elastic member, fitted around the peripheral wall of the outer housing, wherein the inner housing and the outer housing are engaged with each other such that a front end portion of the peripheral wall of the outer housing is inserted into the gap formed between the inner peripheral wall and the outer peripheral wall of the inner housing, and such that a rear end face of the outer peripheral wall of the inner housing is brought into an intimate contact with the second elastic member; and wherein the inner housing and the outer housing are engaged with each other such that a clearance is formed between an outer face of the inner peripheral wall of the inner housing and an inner face of the peripheral wall of the outer housing.

2. The connector as set forth in claim 1, wherein the inner housing has an insertion hole through which another terminal to be connected with the terminal is received.

* * * * *